United States Patent [19]

Kälin

[11] Patent Number: 4,676,136

[45] Date of Patent: Jun. 30, 1987

[54] APPARATUS FOR RECOILLESS FIRING OF PROJECTILES FROM A LAUCHING TUBE

[75] Inventor: Arthur Kälin, Einsiedeln, Switzerland

[73] Assignee: Werkzeugmaschinenfabrik Oerlikon-Bührle AG, Zurich, Switzerland

[21] Appl. No.: 930,916

[22] Filed: Nov. 17, 1986

[30] Foreign Application Priority Data

Nov. 29, 1985 [CH] Switzerland ..... 05116/85

[51] Int. Cl.[4] ..... F41F 3/02

[52] U.S. Cl. ..... 89/1.701; 89/1.703; 89/1.704

[58] Field of Search ..... 89/1.7–1.706

[56] References Cited

U.S. PATENT DOCUMENTS

| | | | |
|---|---|---|---|
| 3,338,133 | 8/1967 | Grandy | 89/1.706 X |
| 3,380,340 | 4/1968 | Bergman et al. | 89/1.706 X |
| 3,779,130 | 12/1973 | Schnabele | 89/1.701 |
| 4,026,189 | 5/1977 | Akhagen et al. | 89/1.703 |
| 4,132,148 | 1/1979 | Meistring et al. | 89/1.704 X |
| 4,172,420 | 10/1979 | Voss et al. | 89/1.701 X |
| 4,484,524 | 11/1984 | Dawant et al. | 89/1.701 X |

FOREIGN PATENT DOCUMENTS

| | | |
|---|---|---|
| 3102734 | 8/1982 | Fed. Rep. of Germany . |
| 2752844 | 8/1982 | Fed. Rep. of Germany . |
| 2530331 | 1/1984 | France . |

*Primary Examiner*—David H. Brown

*Attorney, Agent, or Firm*—Werner W. Kleeman

[57] ABSTRACT

An apparatus for recoilless firing of projectiles from a launching tube comprises within the launching tube a forward brake ring, a forward sabot, a propellant charge with an ignition element or screw, a rear sabot, a counter-mass, and a rear brake ring, arranged within the launching tube in the sequence listed. Upon ignition of the propellant charge, high acceleration forces are created by the ensuing high peak pressures, which consequently requires a robust construction. In order to avoid this drawback, according to the invention the aforementioned disadvantage can be eliminated by using a propellant charge comprising a first cylindrical propellant charge body and a second annular propellant charge body which surrounds this first cylindrical propellant charge body.

17 Claims, 4 Drawing Figures

APPARATUS FOR RECOILLESS FIRING OF PROJECTILES FROM A LAUCHING TUBE

BACKGROUND OF THE INVENTION

The present invention broadly relates to a new and improved apparatus for recoilless firing of projectiles from a launching tube or firing barrel.

In its more specific aspects, the present invention relates to a new and improved apparatus for recoilless firing of projectiles from a launching tube or firing barrel, comprising a forward brake or retaining ring, a forward piston or sabot, a propellant charge with a firing or ignition screw, a rear piston or sabot, a counter-mass and a rear brake or retaining ring.

An apparatus of this general type has already been described in the German Patent Publication No. 2,140,875, wherein there is arranged a propellant charge between two pistons or sabots, causing the two pistons within the launching tube to be displaced in respective forward and rearward directions upon ignition of the propellant charge. A first one of the pistons transports the projectile forwardly to exit from the launching tube. This first piston strikes against the forward brake ring and the second piston pushes the counter-mass until it protrudes from the rear end of the weapon barrel or launching tube when this second piston strikes the rear brake ring.

For recoilless operation it is essential that the weight of the projectile and the weight of the counter-mass be arranged in a predetermined mutual relationship. Furthermore, the path traveled by the forward piston as well as the path traveled by the rearward piston, for expulsion of the projectile and thrusting of the counter-mass, must also be arranged in a predetermined mutual relationship in order to avoid any recoil effects. In order to prevent propellant gases from leaving the launching tube, the two pistons are retained at each end of the launching tube by the brake rings, such that the launching tube remains sealed. Flame and smoke generation as well as firing noise can thus be avoided, which is necessary to avoid revealing the position of the launching tube to the enemy or for permitting firing of the projectile from an enclosed space.

The acceleration paths of the pistons are limited in accordance with the length of the launching tube. In order to nevertheless obtain a high muzzle velocity of the projectile, a high pressure of the propellant gases is required. In order to avoid damage to the launching tube, to the pistons and to the projectile by these high pressures, a suitable, robust construction of these elements is necessary, causing the weapon to become heavy and no longer transportable by an individual artilleryman.

In order to avoid excessive pressures, extensible or telescoping launching tubes of this general type have already been disclosed (see German Patent Publication No. 3,102,734, published Aug. 5, 9182). The apparatus, when in primed condition, includes an arrangement comprising an internal tube located between the propellant charge and the rear end of the launching tube. The internal tube contains a rear sabot, an ejectable inertial mass, as well as a rear brake ring. The internal tube is telescopically moveable out of the launching tube. This interal tube comprises a stop arrangement at its internal termination and which strikes against a stop arrangement at the rear termination of the launching tube.

Arrangements for avoiding high pressures are also known in the art. Reference is made to the European published Patent Application No. 0,056,789. This European published patent application describes an installation for recoilless firing of a rocket, comprising at least one launching tube and at least one projectile for each launching tube. The launching tube comprises at least one chamber for receiving a stationary propellant charge. The rocket projectile possesses at least one propellant charge for sustaining the launching speed or muzzle velocity and for elimination of side wind effects. One embodiment exhibits two stationary propellant charges and two propellant charges within the projectile.

Furthermore, there is known to the art a certain type of warhead with adjustable propellant charge for different firing ranges (see German Patent Publication 2,752,844, published Aug. 19, 1982). This warhead may be fired from a nozzle cannon without recoil effect. The propellant charge is subdivided such that a portion of, or the entire propellant charge can be ignited as desired. A certain portion of the propellant charge is fastened to the warhead and a certain portion of the propellant charge is located in a compartment of the nozzle cannon. The propellant compartment of the nozzle cannon is arranged in an annular configuration around the nozzle barrel of the nozzle cannon, while the outside wall is constructed in a pressure-resistant configuration. The inside wall for the section containing the propellant charge is of a permeable configuration.

The known arrangements for recoilless firing of projectiles from a launching tube are afflicted with high peak pressure effects, despite telescoping-type internal tubes for extension of the acceleration path and despite multi-stage configurations, since propellant charges are used which have gas pressure characteristics similar to propellant charges used for artillery. Upon igniting a propellant charge, the developing gases generate a pressure peak within the combustion chamber which still further increases as soon as the projectile starts moving.

As soon as the combustion chamber starts to increase in size at an increasing rate, caused by the displacement of the projectile, the pressure starts to diminish again. In accordance with the behavior of the propellant charge powder and in accordance with the acceleration of the projectile, as well as a thus effected expansion of the combustion chamber, the gas pressure is reduced at a higher or lower rate. The higher the peak pressure, the higher is the initial acceleration of the projectile, thus requiring a robust construction of the projectile. With multi-stage arrangements only a rapid decrease of pressure within the combustion chamber can be avoided—however, the disadvantageous high pressure peak cannot be eliminated.

SUMMARY OF THE INVENTION

Therefore, with the foregoing in mind, it is a primary object of the present invention to provide a new and improved construction of a launching tube for recoilless firing of projectiles or the like which does not exhibit the aforementioned drawbacks and shortcomings of prior art constructions.

A further significant object of the present invention is to provide a new and improved construction of a launching tube for recoilless firing of projectiles which does not require a telescoping inside tube and which avoids high initial pressures and peaks pressures and in which during the entire ejection process the pressure of the propellant gases is as constant as possible. The apparatus is constructed such that the gas pressure remains as constant as possible during the entire acceleration path of the projectile, i.e. during the entire ejection path within the launching tube. The apparatus is suited for firing projectiles having an auxiliary rocket drive.

Now in order to realize these and other objects of the invention which will become more readily apparent as the description proceeds, the launching tube of the present invention is manifested by the features that the propellant charge comprises a first substantially cylindrical propellant charge body and a second substantially annular propellant charge body which substantially surrounds the first substantially cylindrical propellant charge body.

According to a preferred embodiment of the invention the forward and rearward sabots or pistons conjointly form an inner cylindrical cavity for the first propellant charge body and an outer annular cavity for the second propellant charge body. The outer cavity is further delimited by the launching tube.

In other words, the inventive apparatus for recoilless firing of projectiles from a launching tube is manifested by the features that the launching tube comprises a first end and a second end, the first end of the launching tube serving as an exit aperture for a projectile and defining a front end of the launching tube and the second end of the launching tube being oppositely located with respect to the first end and defining a rear end of the launching tube. The launching tube is constructed to accommodate a projectile to be fired and comprises a forward first brake ring and a rear second brake ring. A counter-mass is provided for compensating the thrust of the projectile. A forward first sabot or piston and a rear second sabot or piston conjointly define a substantially cylindrical internal cavity. A propellant charge comprises a substantially cylindrical first propellant charge body, a substantially annular second propellant charge body at least partially surrounding the substantially cylindrical first propellant charge body and an ignition element or screw. The substantially cylindrical internal cavity accommodates the substantially cylindrical first propellant charge body and a substantially annular external cavity also defined by the first sabot and the second sabot accommodates the second propellant charge body. The launching tube also serves to define the substantially annular external cavity. A counter-mass is also provided.

Differently expressed, the apparatus for recoilless firing of a projectile is manifested by the features that it comprises a substantially tubular launching barrel for accommodating the projectile to be fired. The launching barrel having a first end and a second end and defining a firing direction for the projectile extending from the second end to the first end. The launching tube comprises a first brake ring and a second brake ring; the second brake ring being arranged in the region of the second end. The first brake ring is arranged at a location intermediate the first end and the second end. The launching tube having a substantially constant first internal diameter at least between the first brake ring and the second brake ring. A substantially tubular sleeve is provided which has a second internal diameter inferior to the substantially constant first internal diameter Radial support means serve for mounting the sleeve substantially concentrically within the launching tube at a location intermediate the first brake ring and the second brake ring. A substantially discoidal first sabot is translatably arranged within the launching tube between the first brake ring and the second brake ring. A substantially discoidal second sabot is translatably arranged within the launching tube between the first sabot and the second brake ring. A propellant charge comprises a substantially cylindrical first charge body and a substantially annular second charge body, and an ignition element or screw extends from the exterior through the second charge body into the first charge body. The substantially cylindrical second charge body is arranged within a cavity defined conjointly by the first charge body, the first sabot and the second sabot. The substantially annular first charge body is arranged within a cavity defined conjointly by the launching tube, the first sabot and the second sabot which at least partially surrounds the first charge body. The first sabot engages the projectile for imparting an initial muzzle velocity thereto in the firing direction upon ignition of the propellant charge. A counter-mass provides an internal resistance to the second sabot in the firing direction upon ignition of the propellant charge and the second sabot engages the counter-mass.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
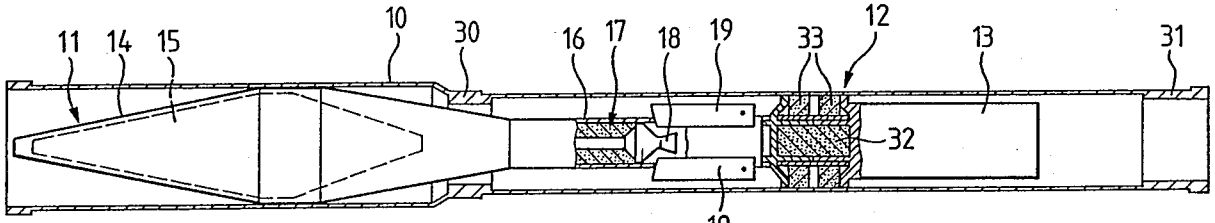
FIG. 1 shows a schematic depiction of a firing apparatus constituted by a launching tube containing a projectile in firing position.

Describing now the drawings, it is to be understood that, to simplify the showing thereof, only enough of the structure of the apparatus for recoilless firing of projectiles from a launching tube or barrel has been illustrated herein as is needed to enable one skilled in the art to readily understand the underlying principles and concepts of the present invention. Turning now specifically to FIG. 1 of the drawings, the apparatus illustrated therein by way of example and not limitation will be seen to comprise a launching tube 10. A projectile 11 is located in the launching tube 10, and is supported by an ejector 12. Behind the ejector 12 within the launching tube 10 there is additionally arranged a counter-mass 13. The projectile 11 comprises a warhead 14 containing a hollow charge or shaped charge 15. At the warhead 14 there is affixed a tube 16 containing an auxiliary rocket propulsion drive 17. The rear of the auxiliary rocket propulsion drive 17 comprises a nozzle 18 which, upon ignition of the auxiliary rocket propulsion drive 17, releases hot gases. At the rearmost location or end of the tube 16 there is arranged a plurality of deflectable vanes 19, FIG. 1 showing only two such deflectable vanes 19. These deflectable vanes 19 are deflected by approximately 100° as soon as the projectile 11 has left the launching tube 10.

Figure 2:
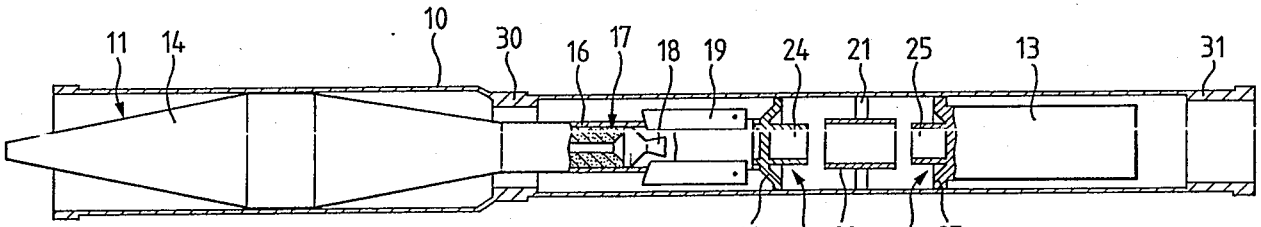
FIG. 2 shows the same firing apparatus containing a projectile shortly after firing.

The ejector 12 which is located behind the projectile 11 constitutes an essential part of the firing apparatus i.e. launching tube. According to FIG. 2 this ejector 12 comprises a stationary sleeve 20 which is affixed to the launching tube 10 by means of radial supporting elements 21 located within the launching tube 10. The depiction in FIG. 2 shows only two of these radial supporting elements 21. On both sides of the stationary sleeve 20 there is located a respective piston or sabot 22 and 23. These two pistons or sabots 22 and 23 each comprise a respective propellant charge sleeve or collar 24 and 25, while each propellant charge sleeve or collar 24 and 25 is affixed to a respective discoidal plate or piston member 26 and 27. At the opposite side of each discoidal plate or piston member 26 and 27 there is respective guiding sleeve or collar 28 and 29 serving to guide the projectile 11 and the counter-mass 13, respectively.

Figure 3:
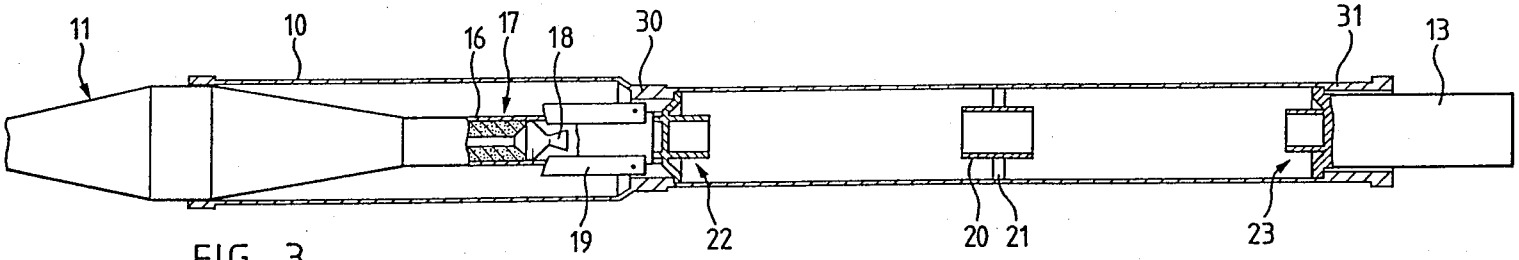
FIG. 3 shows the same apparatus as shown in FIG. 1 and FIG. 2 at a somewhat later instant.

According to FIG. 3 the two pistons or 22 and 23 can move to the left or, respectively, to the right or, as seen in the firing direction, forward or backward until each sabot 22 and 23 strikes a respective damping element defined by the brake or retaining rings 30 and 31.

Figure 4:
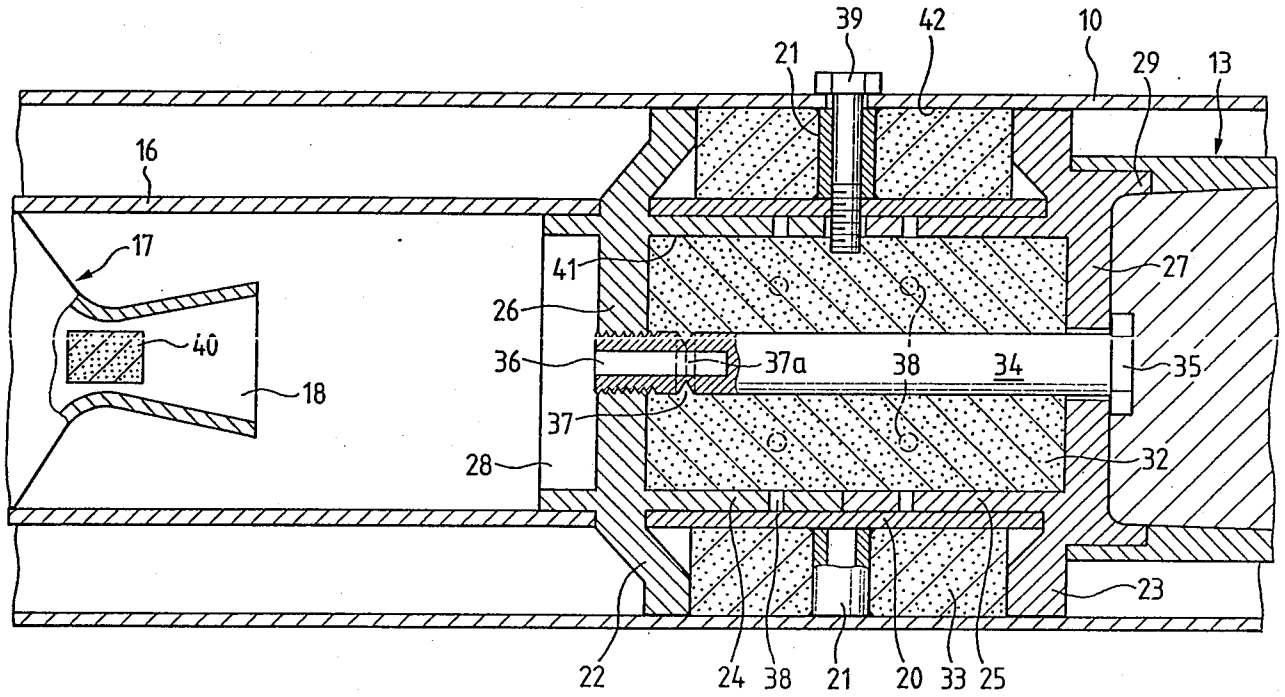
FIG. 4 shows an enlarged detail of FIG. 1 comprising the propellant charge and the pistons or sabot.

According to FIG. 4 the two pistons or 22 and 23 together with associated propellant charge sleeves or collars 24 and 25 protrude as far as the center of the stationary sleeve 20. These associated propellant charge sleeves or collars 24 and 25 conjointly define a cavity 41 within which there is located a first cylindrical propellant charge body 32. Within a second cavity 42, located between the stationary sleeve 20 and the launching tube 10, there is located a second annular propellant charge body 33.

The two pistons or sabots 22 and 23 are interconnected by means of a threaded pin or screw 34. The discoidal plate or piston member 27 of the piston or sabot 23 bears against a head 35 of the threaded pin or screw 34. The other end of the threaded pin or screw 34 is screwed into the discoidal plate or piston member 26 of the second piston or sabot 22. The threaded pin or screw 34 comprises at its front end a longitudinal bore 36 and a predetermined fracture location 37. The predetermined fracture location 37 comprises an annular notch 37*a* in the threaded pin or screw 34 as well as the longitudinal bore 36 of the threaded pin or screw 34. Both propellant charge sleeves or collars 24 and 25 are equipped with gas escape orifices 38. For igniting the first propellant charge 32 there is arranged an ignition element or screw 39 within one of the radial supporting elements 21.

The longitudinal bore 36 of the threaded pin or screw 34 makes it possible to ignite an ignition charge 40 by means of the first propellant charge 32. This ignition charge 40 is located within the nozzle 18. The auxiliary rocket propulsion drive 17 (FIG. 1) can be ignited by the ignition charge 40.

The operation of the apparatus for recoilless firing of projectiles from a launching tube as hereinbefore described, is as follows:

For firing a projectile 11, the first propellant charge 32 is ignited by means of the ignition element or screw 39. Due to the pressure of the developing propellant charge gases, the threaded pin or screw 34 breaks at its reference or predetermined fracture location 37. The propellant charge sleeves or collars 24 and 25 together with the stationary sleeve 20 absorb the developing pressure. Initial forces exerted upon the projectile 11 and the counter-mass 13 are still relatively moderate, since the discoidal plates or piston members 26 and 27 are not subjected over their entire surface to the pressure of the propellant charge gases. Thus, initially, the projectile 11 and the counter-mass 13 are not propelled by the full acceleration force.

Breakage of the threaded pin or screw 34 causes propellant gases to flow via longitudinal bore 36 of the threaded pin or screw 34 and to ignite via the ignition charge 40 the auxiliary rocket propulsion drive 17. The instant at which the secondary annular propellant charge 33 is ignited depends on the size and also particularly on the arrangement of the gas passage or escape orifices 38. If no such gas passages or escape orifices 38 are provided, the ignition of the second propellant charge 33 takes place only after the two propellant charge sleeves or collars 24 and 25 have been fully expelled from the stationary sleeve 20.

Upon ignition of the second propellant charge body 33, or in other words upon the expulsion of the propellant charge sleeves or collars 24 and 25 from the stationary sleeve 20, the propellant charge pressure is exerted on the entire surface of the discoidal plates or piston members 26 and 27. At constant propellant gas pressure, the acceleration forces acting upon the projectile 11 and the counter-mass 13 experience an increase, while, even under decreasing gas pressure, the acceleration forces do not decrease.

As soon as both pistons or sabots 22 and 23 have completed the entire stroke or acceleration path, they each strike against the respective damping elements defined by the brake or retaining rings 30 and 31. The launching tube 10 remains closed within the area encompassing both pistons or sabots 22 and 23 such that the propellant charge gases cannot escape, thus considerably reducing firing noise as well. When the pistons or sabots 22 and 23 strike the damping elements defined by the brake or retaining rings 30 and 31, the projectile 11 as well as the counter-mass 13 exit from the launching tube 10. The projectile 11 is further accelerated, or at least not decelerated, during the initial phase, by the auxiliary rocket drive 17. Since the inner space of the launching tube 10 is closed off by the pistons or sabots 22 and 23, the entrapped propulsion gases will escape relatively slowly by means of the longitudinal bore 36 within the center of the discoidal plate or piston member 26, thus eliminating any annoyance to the operator.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for recoilless firing of projectiles from a launching tube, wherein:

said launching tube comprises a first end and a second end;

said first end of said launching tube serving as an exit aperture for a projectile and defining a front end of said launching tube;

said second end of said launching tube being oppositely located with respect to said first end and defining a rear end of said launching tube;

said launching tube being constructed to accommodate a projectile to be fired;

a forward first brake ring;

a rear second brake ring;
a counter-mass for compensating the thrust of said projectile;
a forward first sabot;
a propellant charge, comprising:
a substantially cylindrical first propellant charge body; and
a substantially annular second propellant charge body at least partially surrounding said substantially cylindrical first propellant charge body;
an ignition element;
a rear second sabot; and
said first sabot and said second sabot conjointly defining a substantially cylindrical internal cavity for accommodating said substantially cylindrical first propellant charge body and in conjunction with said launching tube a substantially annular external cavity for accommodating said substantially annular second propellant charge body.

2. The apparatus as defined in claim 1, wherein:
said forward first sabot defines a first piston and said rear second sabot defines a second piston;
said first piston comprising a first discoidal plate provided with a first sleeve;
said second piston comprising a second discoidal plate provided with a second sleeve;
said first sleeve and said second sleeve conjointly containing said substantially cylindrical first propellant charge body; and
said substantially annular second propellant charge body surrounding said first sleeve and said second sleeve.

3. The apparatus as defined in claim 2, wherein:
said first piston and said second piston are respectively provided with a fourth sleeve and a fifth sleeve;
said fourth sleeve extending into said projectile; and
said fifth sleeve extending into said counter-mass.

4. The apparatus as defined in claim 2, further including:
a threaded pin having a predetermined fracture location; and
said first piston and said second piston being mutually connected by said threaded pin.

5. The apparatus as defined in claim 4, wherein:
said threaded pin includes an axial bore for igniting an auxiliary rocket drive by said propellant charge upon fracture of said threaded pin, at said predetermined fracture location.

6. The apparatus as defined in claim 2, further including:
a radial support arrangement within said launching tube;
a stationary third sleeve being affixed within said launching tube by means of said radial support arrangement; and
said first sleeve and said second sleeve extending within said stationary third sleeve.

7. The apparatus as defined in claim 6, wherein:
said ignition element is arranged within said radial support arrangement; and
said ignition element serving for igniting said substantially cylindrical first propellant charge body.

8. The apparatus as defined in claim 6, wherein:
said first sleeve and said second sleeve conjointly contain said substantially cylindrical first propellant charge body; and
said first sleeve and said second sleeve including orifices for igniting said substantially annular second propellant charge body by said substantially cylindrical first propellant charge.

9. An apparatus for recoilless firing of a projectile, comprising:
a substantially tubular launching tube for accommodating the projectile to be fired;
said launching tube having a first end and a second end and defining a firing direction for the projectile extending from said second end to said first end;
said launching tube comprising a first brake ring and a second brake ring;
said second brake ring being arranged in the region of said second end;
said first brake ring being arranged at a location intermediate said first end and said second end;
said launching tube having a substantially constant internal diameter at least between said first brake ring and said second brake ring;
a substantially discoidal first sabot translatably arranged within said launching tube between said first brake ring and said second brake ring;
a substantially discoidal second sabot translatably arranged within said launching tube between said first sabot and said second brake ring;
a propellant charge comprising a substantially cylindrical first charge body, a substantially annular second charge body;
an ignition element extending from the exterior through said second charge body to said first charge body;
said substantially cylindrical first charge body being arranged within a cavity defined conjointly by said substantially annular second charge body, said first sabot and said second sabot;
said substantially annular second charge body being arranged within a cavity defined conjointly by said launching tube, said first sabot and said second sabot and at least partially surrounding said substantially cylindrical first charge body;
said first sabot engaging the projectile for imparting an initial muzzle velocity thereto in said firing direction upon ignition of said propellant charge;
a counter-mass for providing an inertial resistance to said second sabot in said firing direction upon ignition of said propellant charge; and
said second sabot engaging said counter-mass.

10. The apparatus as defined in claim 9, wherein:
said first and second sabots each have an external diameter substantially corresponding to said substantially constant internal diameter of said launching tube; and
said first and second brake rings each having an internal diameter appreciably inferior to said external diameter of said first and second sabots such that respective shoulders are formed restraining said first and second sabots from escaping from said launching tube.

11. The apparatus as defined in claim 10, wherein:
said first and second saobts each comprise a piston member and a substantially tubular charge collar at least partially surrounding said substantially cylindrical first charge body and at least partially surrounded by said substantially annular second charge body.

12. The apparatus as defined in claim 11, wherein:

each said piston member is integrally provided with a respective engagement collar;

said respective engagement collar of said piston member of said first sabot extending into the projectile to be launched; and said respective engagement collar of said piston member of said second sabot extending into said counter-mass.

13. The apparatus as defined in claim 11, further including:

a threaded pin for interconnecting said first and said second sabots; and said threaded pin having a predetermined fracture location.

14. The apparatus as defined in claim 13, wherein:

the projectile comprises an auxiliary rocket propulsion means;

said threaded pin being provided with an axial bore for effecting ignition of said auxiliary rocket propulsion means upon fracture of said threaded pin at said predetermined fracture location.

15. The apparatus as defined in claim 11, further including:

a substantially tubular stationary sleeve having a further internal diameter inferior to said substantially constant internal diameter of said launching tube;

radial support means for mounting said stationary sleeve substantially concentrically within said launching tube at a location intermediate said first brake ring and said second brake ring; and each said charge collar of said first and second sabots extending within said internal diameter of said stationary sleeve.

16. The apparatus as defined in claim 15, wherein:

said radial support means comprises at least one radial support member; and said ignition element being arranged in said at least one radial support member such that said ignition element serves for igniting said substantially cylindrical first charge body.

17. The apparatus as defined in claim 15, wherein:

each said substantially tubular charge collar is provided with at least one gas escape orifice for effecting ignition of said substantially annular second charge body by said substantially annular first charge body.

* * * * *

UNITED STATES PATENT AND TRADEMARK OFFICE

CERTIFICATE OF CORRECTION

PATENT NO. : 4,676,136

DATED : June 30, 1987

INVENTOR(S) : ARTHUR KÄLIN

It is certified that error appears in the above-identified patent and that said Letters Patent is hereby corrected as shown below:

Column 1, line 59, please delete "9182" and insert --1982--

Column 1, line 66, please delete "interal" and insert --internal--

Column 3, line 64, after "diameter" please insert --.-- (period)

Column 5, line 17, after "is" please insert --affixed a--

Column 5, line 21, after "or" please insert --sabots--

Column 5, line 26, after "or" please insert --sabots--

Column 8, line 62, please delete "saobts" and insert --sabots--

Signed and Sealed this

Fifteenth Day of March, 1988

*Attest:*

*Attesting Officer*

DONALD J. QUIGG

*Commissioner of Patents and Trademarks*